US009001009B2

(12) United States Patent
Choi

(10) Patent No.: US 9,001,009 B2
(45) Date of Patent: Apr. 7, 2015

(54) PIXEL AND ORGANIC LIGHT EMITTING DISPLAY USING THE SAME

(75) Inventor: Sang-Moo Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 242 days.

(21) Appl. No.: 13/493,982

(22) Filed: Jun. 11, 2012

(65) Prior Publication Data

US 2013/0002632 A1 Jan. 3, 2013

(30) Foreign Application Priority Data

Jun. 30, 2011 (KR) ..... 10-2011-0064440

(51) Int. Cl.
*G09G 3/32* (2006.01)

(52) U.S. Cl.
CPC ..... *G09G 3/325* (2013.01); *G09G 2310/0262* (2013.01); *G09G 2320/0233* (2013.01); *G09G 2300/0861* (2013.01)

(58) Field of Classification Search
CPC ..... G09G 3/30; G09G 3/36; G09G 3/038; G09G 3/32
USPC ..... 345/92, 76
See application file for complete search history.

(56) References Cited

U.S. PATENT DOCUMENTS

| | | | | |
|---|---|---|---|---|
| 7,755,585 | B2 * | 7/2010 | Kim | 345/92 |
| 2004/0145547 | A1 * | 7/2004 | Oh | 345/76 |
| 2006/0077138 | A1 * | 4/2006 | Kim | 345/76 |
| 2007/0268217 | A1 * | 11/2007 | Ahn et al. | 345/76 |
| 2008/0211747 | A1 * | 9/2008 | Kim | 345/76 |
| 2008/0224965 | A1 * | 9/2008 | Kim | 345/76 |
| 2012/0062536 | A1 | 3/2012 | Park | |

FOREIGN PATENT DOCUMENTS

| | | | |
|---|---|---|---|
| KR | 10-2009-0087831 | A | 8/2009 |
| KR | 10-2012-0028013 | A | 3/2012 |

* cited by examiner

*Primary Examiner* — Dwayne Bost
*Assistant Examiner* — Chineyere Wills-Burns
(74) *Attorney, Agent, or Firm* — Christie, Parker & Hale, LLP

(57) ABSTRACT

A pixel includes an organic light emitting diode (OLED) having a cathode electrode coupled to a second power source, a first transistor having a first electrode coupled to a first power source, the first transistor being configured to control a magnitude of a current supplied from the first power source to the second power source via the OLED in accordance with a data signal, and a plurality of second transistors serially coupled between a gate electrode of the first transistor and a power source line, the second transistors being configured to be turned on when a second scan signal is supplied to a second scan line, wherein a common node between the second transistors is electrically coupled to the first electrode or a second electrode of the first transistor.

17 Claims, 7 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 10-2011-0064440, filed on Jun. 30, 2011 in the Korean Intellectual Property Office, the entire disclosure of which is incorporated herein by reference.

BACKGROUND

1. Field

Embodiments of the present invention relate to a pixel and an organic light emitting display using the same, and more particularly, to a pixel capable of displaying an image having substantially uniform brightness and an organic light emitting display using the same.

2. Description of the Related Art

Recently, various types flat panel displays (FPD) that are capable of reducing weight and volume that are disadvantages of cathode ray tubes (CRT) have been developed. The types of FPDs include liquid crystal displays (LCD), field emission displays (FED), plasma display panels (PDP), and organic light emitting displays.

Among the FPDs, the organic light emitting displays display images using organic light emitting diodes (OLEDs) that generate light by the re-combination of electrons and holes. The organic light emitting display has high response speed and can be driven with low power consumption.

Generally, an organic light emitting display includes a plurality of data lines, scan lines, and a plurality of pixels arranged in a matrix at crossing regions of the scan lines and the data lines. The pixels commonly include organic light emitting diodes (OLEDs) and driving transistors for controlling the amount of a current that flows to (or through) the OLEDs. The pixels generate light having a brightness level (e.g., a predetermined brightness level) while supplying currents from the driving transistors to the OLEDs to correspond to data signals.

SUMMARY

Accordingly, embodiments of the present invention have been made to provide a pixel capable of displaying an image having substantially uniform brightness and an organic light emitting display using the same.

According to one embodiment of the present invention, a pixel includes an organic light emitting diode (OLED) having a cathode electrode coupled to a second power source, the first transistor having a first electrode coupled to a first power source, the first transistor being configured to control a magnitude of a current supplied from the first power source to the second power source via the OLED in accordance with a data signal, and a plurality of second transistors serially coupled between a gate electrode of the first transistor and a power source line, the second transistors being configured to be turned on when a second scan signal is supplied to a second scan line, wherein a common node between the second transistors is electrically coupled to the first electrode or a second electrode of the first transistor.

The power source line may supply an initialization voltage, the initialization voltage having a voltage lower than a voltage of the data signal. The pixel may further include a third transistor coupled between the first electrode of the first transistor and a data line, the third transistor being configured to be turned on when a first scan signal is supplied to a first scan line, a fourth transistor coupled between the gate electrode of the first transistor and the second electrode of the first transistor, the fourth transistor being configured to be turned on when the first scan signal is supplied to the first scan line, a fifth transistor coupled between the first electrode of the first transistor and the first power source, the fifth transistor being configured to be turned off when an emission control signal is supplied to an emission control line, a sixth transistor coupled between the second electrode of the first transistor and the OLED, the sixth transistor being configured to be turned off when the emission control signal is supplied, and a storage capacitor coupled between the gate electrode of the first transistor and the first power source.

According to another embodiment of the present invention, an organic light emitting display includes a scan driver configured to drive a plurality of first scan lines, a plurality of second scan lines, and a plurality of emission control lines, a data driver configured to supply a plurality of data signals to a plurality of data lines, and a plurality of pixels located at crossing regions of the first scan lines and the data lines, the pixels being arranged in a plurality of horizontal lines. According to one embodiment, each of the pixels includes an OLED having a cathode electrode coupled to a second power source, a first transistor having a first electrode coupled to a first power source, the first transistor being configured to control a magnitude of a current supplied from the first power source to the second power source via the OLED in accordance with the data signal, and a plurality of second transistors serially coupled between a gate electrode of the first transistor and an ith power source line of a plurality of power source lines, the gate electrodes of the second transistors being coupled to an ith second scan line of the second scan lines, wherein a common node between the second transistors is electrically coupled to the first electrode or a second electrode of the first transistor.

An ith (i is a natural number) second scan line of the second scan lines may be electrically coupled to an (i−1)th first scan line of the first scan lines. The scan driver may be configured to sequentially supply first scan signals to the first scan lines and a plurality of second scan signals to the second scan lines to turn on corresponding ones of the transistors and to sequentially supply a plurality of emission control signals to the emission control lines to turn off corresponding ones of the transistors. The scan driver may be further configured to supply a second scan signal to an ith (i is a natural number) second scan line, wherein the second scan signal does not overlap a first scan signal supplied to an ith first scan line, wherein the second scan signal has a larger width than the first scan signal and is supplied to the ith second scan line before the first scan signal is supplied to the ith first scan line.

One of the power source lines may be formed in each horizontal line of the display and each of the power source lines may be coupled to an initialization power source driver configured to drive the power source lines of the horizontal lines. The scan driver may be configured to sequentially supply a first scan signal to each of the first scan lines, to sequentially supply two second scan signals to each of the second scan lines, and to sequentially supply an emission control signal to each of the emission control lines. The scan driver may be configured to supply a first scan signal to an ith (i is a natural number) first scan line after supplying second scan signals to the ith second scan line. The scan driver may be configured to supply an emission control signal to an ith emission control line, wherein the two second scan signals comprises a first second scan signal and a second second scan signal, and wherein the emission control signal overlaps the first scan signal supplied to the ith first scan line and the second second scan signal supplied to the ith second scan line. The initialization power source driver is configured to supply an initialization voltage having a voltage lower than a voltage of the data signal, the initialization voltage being supplied to the ith power source line to overlap the second second scan signal supplied to the ith second scan line. The ith power source line is set in a floating state in periods other than a period in which the initialization power source is supplied.

In the pixel according to embodiments of the present invention and an organic light emitting display using the same, an off bias voltage is applied to the driving transistors included in the pixels to initialize the characteristics of the driving transistors. When the characteristics of the driving transistors included in the pixels are initialized, an image with improved uniformity of brightness may be displayed.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
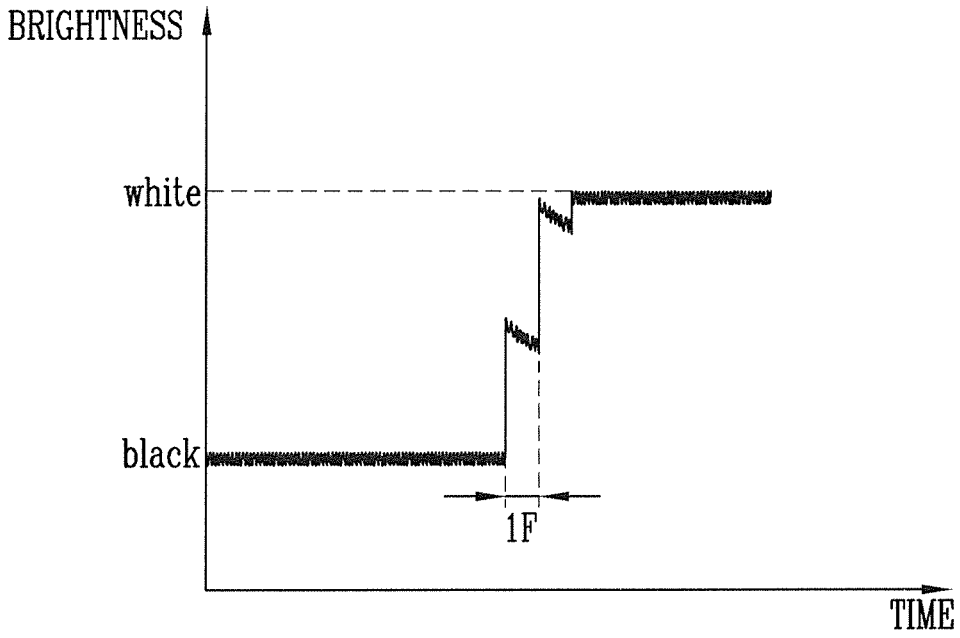
FIG. 1 is a graph illustrating brightness in the case of displaying white gray levels after black gray levels.

In a conventional pixel, when displaying white gray levels after (e.g., immediately after) displaying black gray levels, as illustrated in FIG. 1, light with lower brightness than desired brightness is generated during about two frames. In this case, an image with desired brightness may not be displayed by the pixels in accordance with desired gray levels so that the uniformity of brightness deteriorates, which is a major factor that reduces the quality of a moving picture.

Through experiments, it appears that the deterioration of the response characteristic of the organic light emitting display is caused by the characteristics of the driving transistors included in the pixels. That is, the threshold voltages of the driving transistors shift in accordance with the voltages applied to the driving transistors during a previous frame. Due to the shifted threshold voltages, light with desired brightness may not be generated in the current frame.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

Hereinafter, exemplary embodiments of the present invention, by which those who skilled in the art may perform the present invention, will be described in detail with reference to FIGS. 2 to 10.

Figure 2:
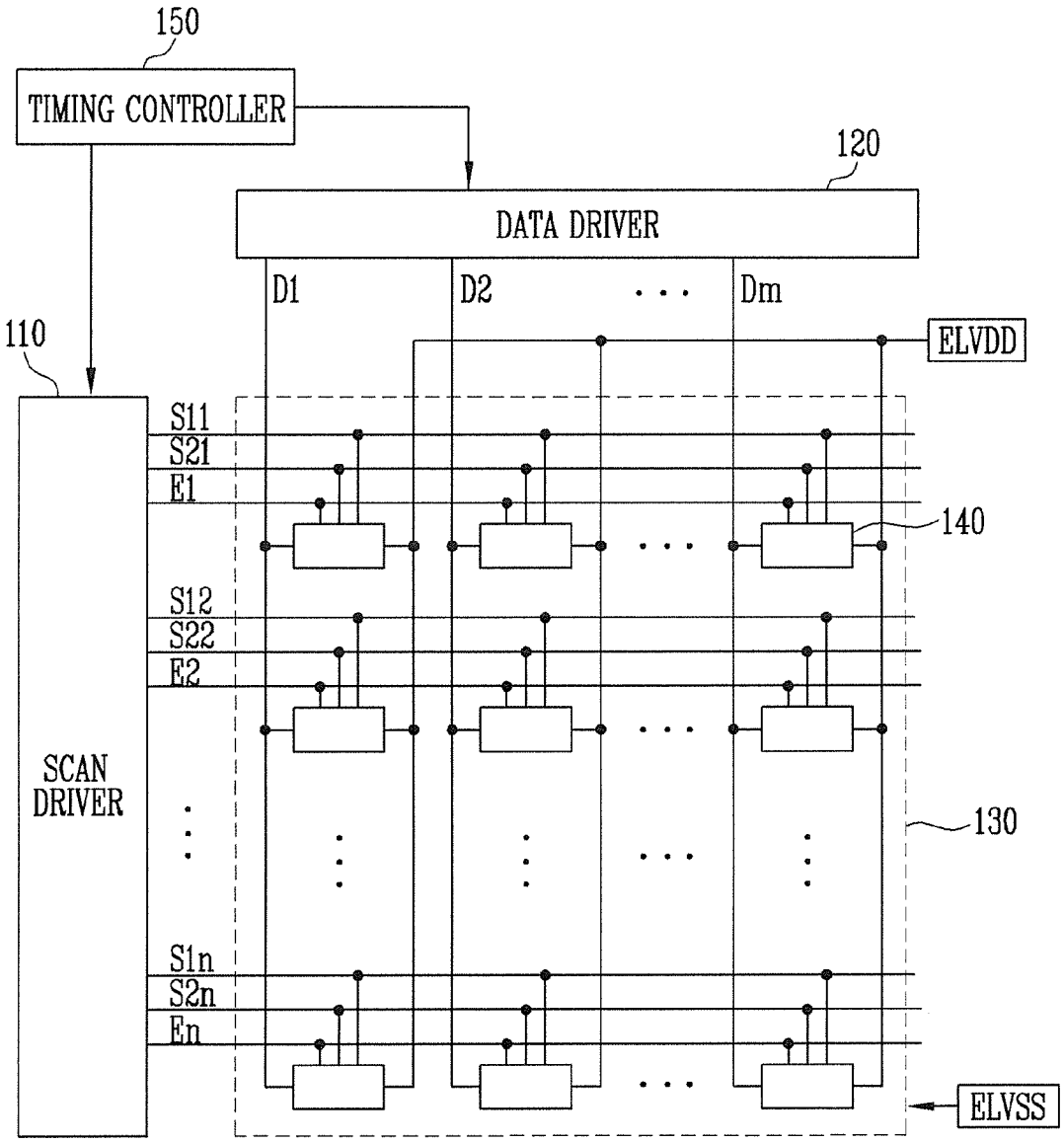
FIG. 2 is a view illustrating an organic light emitting display according to an embodiment of the present invention.

FIG. 2 is a view illustrating an organic light emitting display according to one embodiment of the present invention.

Referring to FIG. 2, an organic light emitting display according to one embodiment of the present invention includes a display unit 130 including pixels 140 coupled to (e.g., at crossing regions of) first scan lines S11 to S1*n* and data lines D1 to Dm, a scan driver 110 for driving the first scan lines S11 to S1*n*, second scan lines S21 to S2*n*, and emission control lines E1 to En, a data driver 120 for driving the data lines D1 to Dm, and a timing controller 150 for controlling the scan driver 110 and the data driver 120.

The scan driver 110 receives a scan driving control signal from the timing controller 150. The scan driver 110 supplies first scan signals to the first scan lines S11 to S1*n* and supplies second scan signals to the second scan lines S21 to S2*n*. In addition, the scan driver 110 generates emission control signals and sequentially supplies the generated emission control signals to the emission control lines E1 to En.

The scan driver 110 supplies a second scan signal to an ith (where i is a natural number) second scan line S2*i* and supplies a first scan signal to the ith first scan line S1*i*, where the first scan signal does not overlap with the second scan signal. Here, because the first scan signal is supplied after the second scan signal is supplied, the ith second scan line S2*i* may be electrically coupled to a previous horizontal line (or row), for example, an ith second scan line S2*i* may be coupled to the (i−1)th first scan line S1*i*-1. In addition, the second scan lines S21 to S2*n* may be formed as separate wiring lines from the first scan lines S11 to S1*n* so that the second scan signal may have a larger width than the first scan signal.

Furthermore, the scan driver 110 supplies an emission control signal to the ith emission control line Ei, where the emission control signal does not overlap the first scan signal supplied to the ith first scan line S1*i* and the second scan signal supplied to the ith second scan line S2*i*. In one embodiment, the first scan signal and the second scan signal are set as voltages (for example, low voltages) at which transistors may be turned on and the emission control signal is set as a voltage (for example, a high voltage) at which the transistors may be turned off.

The data driver 120 receives a data driving control signal from the timing controller 150. The data driver 120 receiving the data driving control signal supplies data signals to the data lines D1 to Dm in synchronization with the first scan signals.

The timing controller 150 generates a data driving control signal and a scan driving control signal corresponding to synchronizing signals supplied from the outside (e.g., an external source). The data driving control signal generated by the timing controller 150 is supplied to the data driver 120 and the scan driving control signal is supplied to the scan driver 110. The timing controller 150 also supplies data supplied from the outside (e.g., the external source) to the data driver 120.

The display unit 130 receives a first power ELVDD (e.g., a first power having a first voltage ELVDD from a first power source) and a second power ELVSS (e.g., a second power having a second voltage ELVSS from a second power source) from the outside to supply the first power ELVDD and the second power ELVSS to the pixels 140. The pixels 140 that receive the first power ELVDD and the second power ELVSS generate lights having brightness (e.g., predetermined brightness components) in accordance with the amounts of currents (e.g., the magnitudes of the currents) that flow from the first power source to the second power source via the OLEDs in accordance with the data signals.

Figure 3:
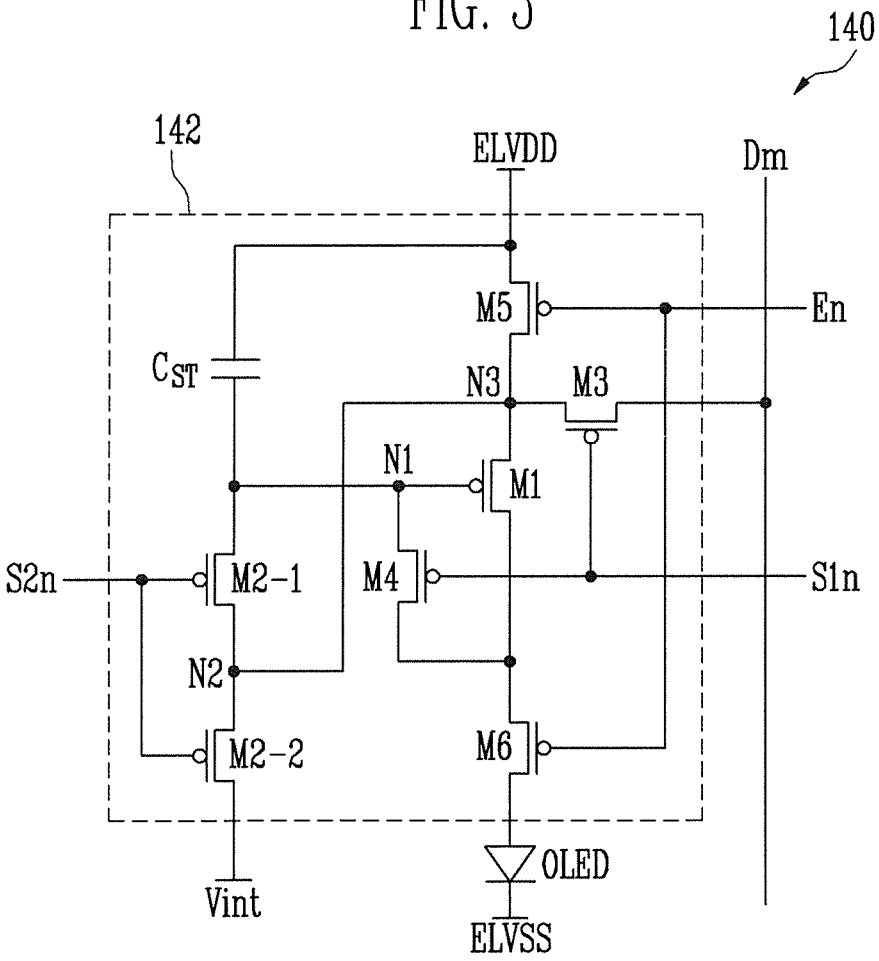
FIG. 3 is a circuit diagram illustrating a first embodiment of the pixel of FIG. 2.

FIG. 3 is a circuit diagram illustrating a first embodiment of the pixel of FIG. 2. In FIG. 3, for the sake of convenience, a pixel positioned in an nth horizontal line (or row) will be illustrated.

Referring to FIG. 3, the pixel 140 according to one embodiment of the present invention includes an organic light emitting diode (OLED) and a pixel circuit 142 coupled to the mth data line Dm, the nth first scan line S1*n*, the nth second scan line S2*n*, and the nth emission control line En to control the amount of current (e.g., the magnitude of the current) supplied to the OLED.

The anode electrode of the OLED is coupled to the pixel circuit 142 and the cathode electrode of the OLED is coupled to the second power source for supplying the second supply voltage ELVSS. The OLED generates light with a brightness (e.g., a predetermined brightness) corresponding to the amount of current (e.g., the magnitude of the current) supplied from the first power source for supplying the first supply voltage ELVDD via the pixel circuit 142.

The pixel circuit 142 controls the amount of current (e.g., the magnitude of the current) supplied to the OLED in accordance with a data signal. Therefore, the pixel circuit 142 includes first to sixth transistors M1 to M6 and a storage capacitor Cst.

The first electrode of the first transistor M1 is coupled to a third node N3 and the second electrode of the first transistor M1 is coupled to the first electrode of the sixth transistor M6. The gate electrode of the first transistor M1 is coupled to a first node N1. The first transistor M1 controls the amount of current (e.g., the magnitude of the current) supplied to the OLED in accordance with a voltage charged (or stored) in the storage capacitor Cst.

The second transistor M2 includes a plurality of transistors M2-1 and M2-2 serially coupled between the first node N1 and an initialization power source Vint supplied from a power source line. The gate electrodes of the second transistors M2-1 and M2-2 are coupled to the second scan line S2*n*. A common node (e.g., a second node N2) between the second transistors M2-1 and M2-2 is electrically coupled to a third node N3. The second transistors M2-1 and M2-2 are turned on when the second scan signal is supplied to the second scan line S2*n* to supply the initialization voltage Vint of the initialization power source to the first node N1 and the third node N3. Here, the initialization voltage Vint of the initialization power source is set to have a lower voltage than a voltage of the data signal.

The first electrode of the third transistor M3 is coupled to the data line Dm and the second electrode of the third transistor M3 is coupled to the third node N3.

The gate electrode of the third transistor M3 is coupled to the first scan line S1*n*. The third transistor M3 is turned on when the first scan signal is supplied to the first scan line S1*n* to electrically couple the data line Dm and the third node N3 to each other.

The first electrode of the fourth transistor M4 is coupled to the second electrode of the first transistor M1 and the second electrode of the fourth transistor M4 is coupled to the first node N1. The gate electrode of the fourth transistor M4 is coupled to the first scan line S1*n*. The fourth transistor M4 is turned on when the first scan signal is supplied to the first scan line S1*n* to diode connect (or diode couple) the first transistor M1.

The first electrode of the fifth transistor M5 is coupled to the first power source for supplying the first supply voltage ELVDD and the second electrode of the fifth transistor M5 is coupled to the third node N3. The gate electrode of the fifth transistor M5 is coupled to the emission control line En. The fifth transistor M5 is turned off when an emission control signal is supplied to the emission control line En and is turned on when the emission control signal is not supplied.

The first electrode of the sixth transistor M6 is coupled to the second electrode of the first transistor M1, and the second electrode of the sixth transistor M6 is coupled to the anode electrode of the OLED. The gate electrode of the sixth transistor M6 is coupled to the emission control line En. The sixth transistor M6 is turned off when the emission control signal is supplied to the emission control line En and is turned on when the emission control signal is not supplied.

The storage capacitor Cst is coupled between the first node N1 and the first power source for supplying the first supply voltage ELVDD. The storage capacitor Cst charges (e.g., stores) a voltage corresponding to both the data signal and the threshold voltage of the first transistor M1.

Figure 4:
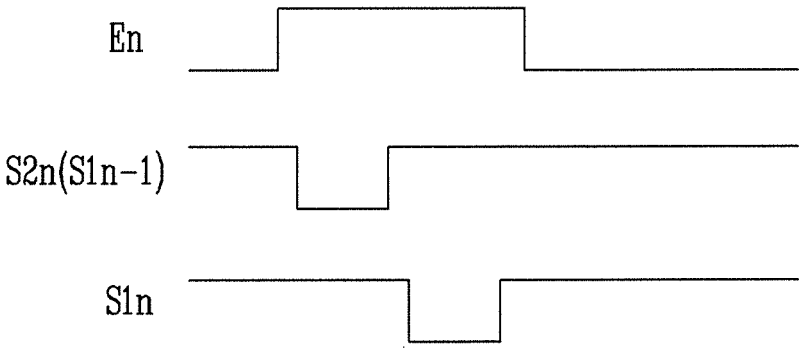
FIG. 4 is a waveform chart illustrating a method of driving the pixel of FIG. 3 according to one embodiment of the present invention.

FIG. 4 is a waveform chart illustrating a method of driving the pixel of FIG. 3. In FIG. 4, it is assumed that the first scan signal of the (i−1)th first scan line S1*n*-1 of the n−1th horizontal line (or row) of pixels is supplied to the second scan line S2*n* of the nth horizontal line (or row) of pixels. In this case, the second scan line S2*n* is not formed as an additional line but is electrically coupled to the first scan line S1*n*-1 of a previous horizontal line (or row) of pixels.

Referring to FIG. 4, first, the emission control signal is supplied to the emission control line En (e.g., the emission control signal is at logic high level when it is uspplied) so that the fifth transistor M5 and the sixth transistor M6 are turned off.

Then, a second scan signal is supplied to the second scan line S2*n* (e.g., the second scan signal is at logic low level when it is supplied). When the second scan signal is supplied to the second scan line S2*n*, the second transistors M2-1 and M2-2 are turned on. When the second transistors M2-1 and M2-2 are turned on, the initialization voltage Vint of the initialization power source is supplied to the first node N1 and the third node N3.

Figure 5:
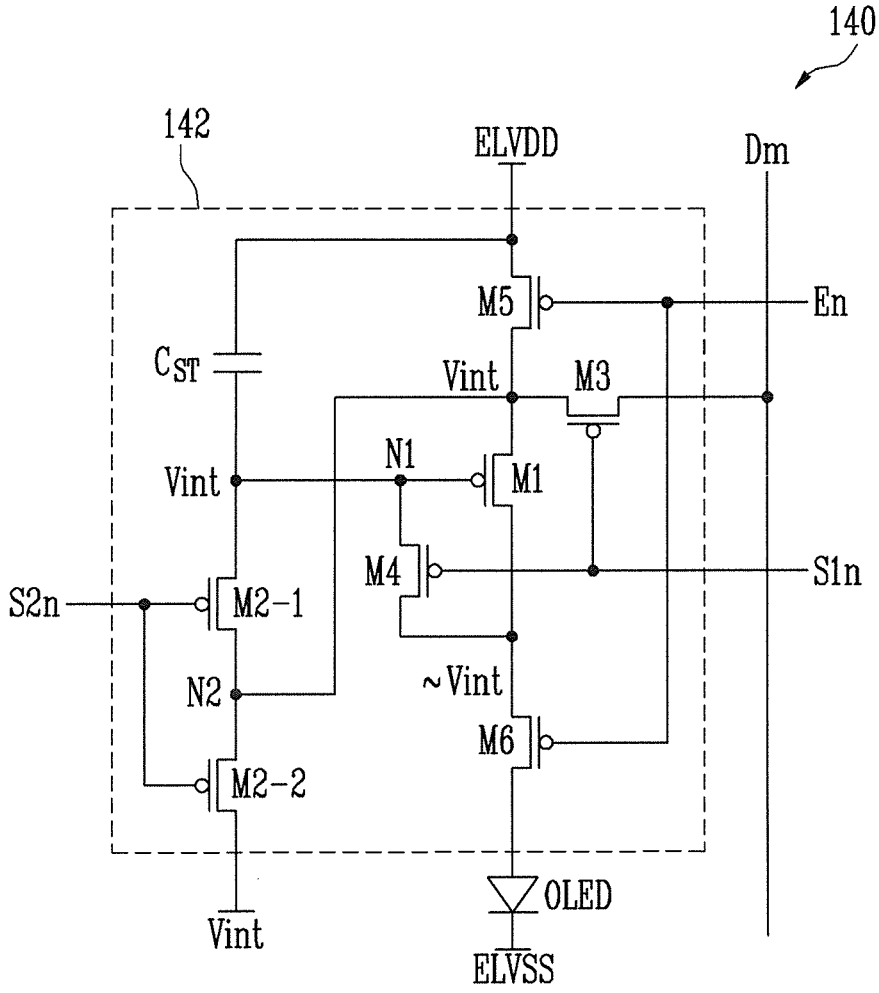
FIG. 5 is an annotated circuit diagram illustrating the voltage applied to the pixel due to the driving waveform of FIG. 4.

When the initialization power source supplies an initialization voltage Vint to the first node N1 and the third node N3, the first transistor M1 is set in a turned-off state to receive an off bias voltage. When the initialization power source supplies the initialization voltage Vint to the first node N1 and the third node N3, as illustrated in FIG. 5, the voltage of the second electrode of the first transistor M1 is reduced to about (or approximately) the voltage of the initialization power source (e.g., ~Vint). When the off bias voltage is supplied to the first transistor M1, the characteristic of the first transistor M1 is initialized to an off bias state.

Then, the first scan signal is supplied to the first scan line S1*n* (e.g., the first scan signal is at a logic low level when it is supplied) so that the third transistor M3 and the fourth transistor M4 are turned on. When the fourth transistor M4 is turned on, the first transistor M1 is diode coupled. When the third transistor M3 is turned on, the data signal from the data line Dm is supplied to the third node N3.

When the first node N1 is set to have the initialization voltage Vint of the initialization power source (which, in one embodiment, is a voltage lower than a voltage of the data signal), the first transistor M1 is turned on. When the first transistor M1 is turned on, the voltage obtained by subtracting the threshold voltage of the first transistor M1 from the data signal is supplied to the first node N1. The storage capacitor Cst charges (e.g., stores) a voltage (e.g., a predetermined voltage) to correspond to the voltage applied to the first node N1.

After the voltage (e.g., the predetermined voltage) is charged (or stored) in the storage capacitor Cst, the supply of the emission control signal to the emission control line En is stopped so that the fifth transistor M5 and the sixth transistor M6 are turned on. When the fifth transistor M5 and the sixth transistor M6 are turned on, a current path from the first power source for supplying the first supply voltage ELVDD to the second power source for supplying the second supply voltage ELVSS, via the OLED, is formed. In one embodiment, the first transistor M1 controls the amount of current (e.g., the magnitude of the current) supplied to the OLED in accordance with the voltage charged (e.g., stored) in the storage capacitor Cst.

According to one embodiment of the present invention, because the initialization voltage Vint of the initialization power source is supplied to the first node N1 and the third node N3 when the second scan signal is supplied, the first transistor M1 is turned off. As described above, when the off bias voltage is applied to the first transistor M1, the characteristic curve (or the threshold voltage) of the first transistor M1 is initialized (e.g., initialized to a specific state). As described above, when the first transistor included in each of the pixels 140 is initialized to a specific state, lights having improved uniformity of brightness are generated by the pixels 140.

Figure 6:
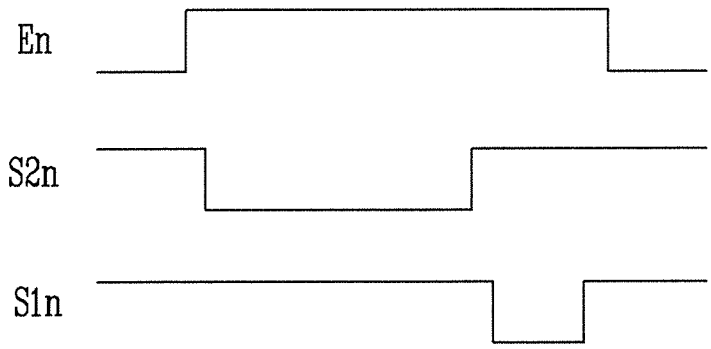
FIG. 6 is a waveform chart illustrating another method of driving the pixel of FIG. 3 according to one embodiment of the present invention.

In the embodiment of FIG. 4, it is assumed that the first scan signal of the first scan line S1*n*-1 of the previous horizontal line is supplied to the second scan line S2*n*. However, embodiments of the present invention are not limited to the above. For example, as illustrated in FIG. 6, the second scan signal may be supplied to have a larger width than the first scan signal. When the second scan signal has a larger width than the first scan signal, the time during which the off bias voltage is applied to the first transistor M1 increases so that the characteristic of the first transistor M1 may be stably initialized. In some embodiments, the width of the second scan signal may be set in the range of no more than 2 H (e.g., twice the period of the first scan signal) to half of one frame so that the characteristic of the first transistor M1 may be stably initialized.

Figure 7:
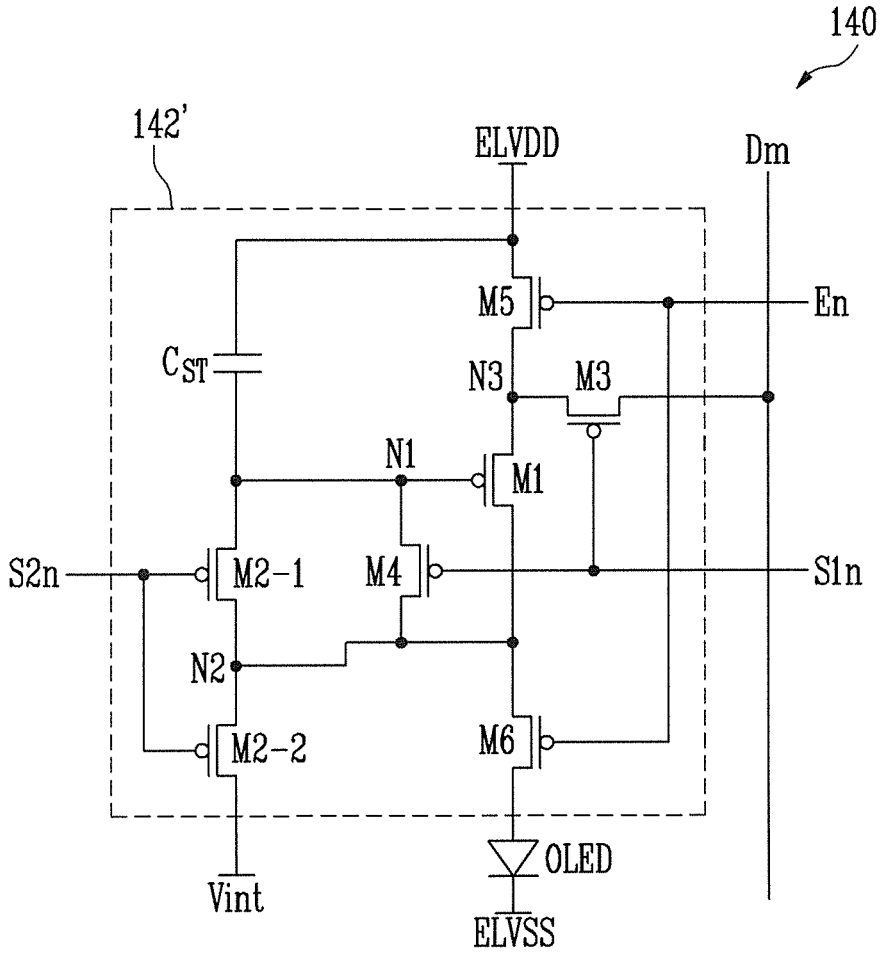
FIG. 7 is a circuit diagram illustrating a second embodiment of the pixel of FIG. 2.

FIG. 7 is a circuit diagram illustrating a second embodiment of the pixel of FIG. 2. When FIG. 7 is described, description of structures that are substantially the same as those of FIG. 3 will be omitted.

Referring to FIG. 7, the second node N2 of a pixel circuit 142' according to the second embodiment of the present invention is coupled to the second electrode of the first transistor M1. In this case, when the second scan signal is supplied to the second scan line S2*n*, the initialization voltage Vint of the initialization power source is supplied to the first node N1 and the second electrode of the first transistor M1.

When the initialization voltage Vint of the initialization power source is supplied to the first node N1 and the second electrode of the first transistor M1, the voltage of the third node N3 is set to about the initialization voltage Vint of the initialization power source. Therefore, during the period in which the second scan signal is supplied to the second scan line S2*n*, the off bias voltage is applied to the first transistor M1. Because the other operation processes and structures are substantially the same as those described above with reference to FIGS. 3, 4, 5, and 6, description thereof will be omitted.

Figure 8:
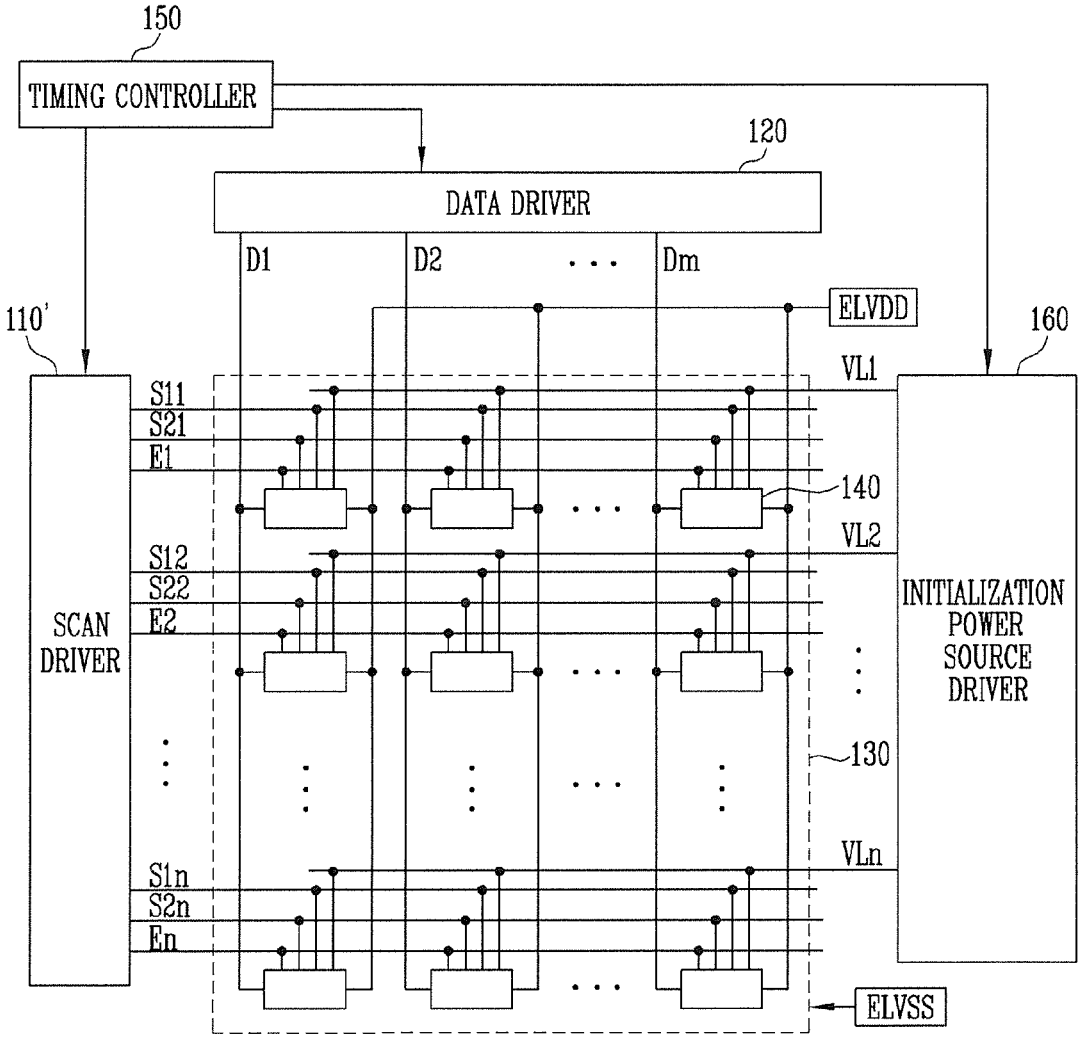
FIG. 8 is a view illustrating an organic light emitting display according to another embodiment of the present invention.

FIG. 8 is a view illustrating an organic light emitting display according to another embodiment of the present invention. When FIG. 8 is described, description of the same structures as those of FIG. 2 will be omitted.

Referring to FIG. 8, an organic light emitting display according to another embodiment of the present invention includes a display unit 130 including pixels 140 coupled to (e.g., at crossing regions of) first scan lines S11 to S1*n* and data lines D1 to Dm, a scan driver 110' for driving the first scan lines S11 to S1*n*, second scan lines S21 to S2*n*, and emission control lines E1 to En, a data driver 120 for driving the data lines D1 to Dm, an initialization power source driver 160 for driving power source lines VL1 to VLn, and a timing controller 150 for controlling the scan driver 110', the data driver 120, and the initialization power source driver 160.

The scan driver 110' sequentially supplies first scan signals to the first scan lines S11 to S1*n* and sequentially supplies second scan signals to the second scan lines S21 to S2*n*. In addition, the scan driver 110' generates emission control signals and sequentially supplies the generated emission control signals to the emission control lines E1 to En.

Figure 10:
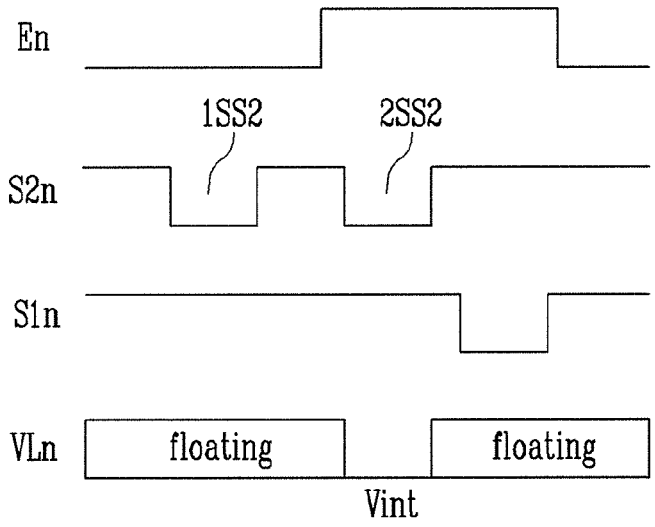
FIG. 10 is a waveform chart illustrating a method of driving the pixel of FIG. 9 according to one embodiment of the present invention.

As illustrated in FIG. 10, according to one embodiment of the present invention, the scan driver 110 supplies two second scan signals 1SS2 and 2SS2 to the ith second scan line S2*i* before a first scan signal is supplied to the ith first scan line S1*i* (the nth first and second scan lines are illustrated in FIG. 10). Here, the first second scan signal 1SS2 is used to apply an off bias voltage to the first transistor M1 included in the pixel 140 and the second second scan signal 2SS2 is used to supply the initialization voltage Vint of the initialization power source to the first node N1 of the pixel 140. In some embodiments, the first second scan signal 1SS2 and the second second scan signal 2SS2 may have a period of no less than a one horizontal period 1H so that the off bias voltage may be stably applied.

Then, the scan driver 110 supplies an emission control signal to the ith emission control line Ei to overlap the first scan signal supplied to the ith first scan line S1*i* and the second second scan signal 2SS2 supplied to the ith second scan line S2*i*.

The initialization power source driver 160 sequentially supplies the initialization voltage Vint to the power source lines VL1 to VLn. Here, the initialization voltage Vint supplied to the ith power source line VLi is supplied to overlap the second second scan signal 2SS2 supplied to the ith second scan line S2*n*. The initialization power source driver 160 maintains the power source line VLi in a floating state during the remaining period (e.g., at times other than when the initialization voltage Vint is supplied to power source line VLi).

Figure 9:
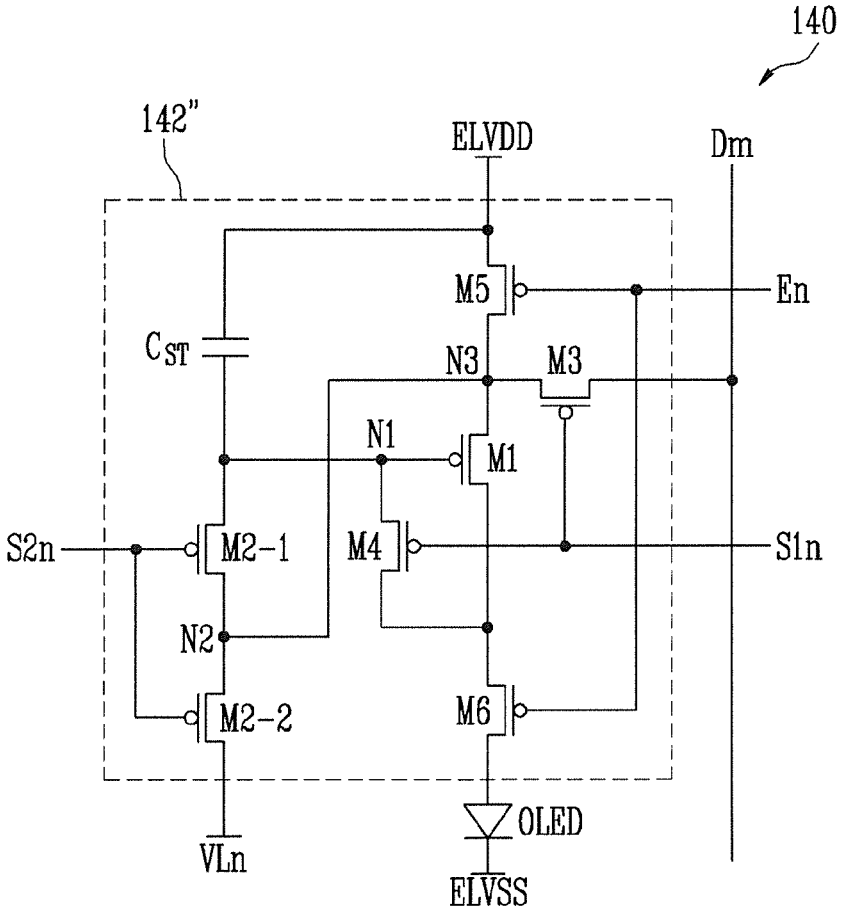
FIG. 9 is a circuit diagram illustrating an embodiment of the pixel of FIG. 8.

FIG. 9 is a circuit diagram illustrating an embodiment of the pixel of FIG. 8. In the description of FIG. 9, description of the same structures as those of FIG. 3 will be omitted.

Referring to FIG. 9, the second transistors M2-1 and M2-2 according to one embodiment of the present invention are coupled between the first node N1 and the power source line VLn. The power source line VLn receives the initialization voltage Vint of the initialization power source when the second second scan signal 2SS2 is supplied to the second scan line S2*n* and is set in a floating state during the other periods (e.g., when the second second scan signal 2SS2 is not supplied).

On the other hand, in FIG. 9, the second node N2 and the third node N3 are electrically coupled to each other. However, embodiments of the present invention are not limited to the above. For example, the second node N2 and the first electrode of the first transistor M1 may be electrically coupled to each other.

FIG. 10 is a waveform chart illustrating a method of driving the pixel of FIG. 9 according to one embodiment of the present invention.

Referring to FIG. 10, first, the first second scan signal 1SS2 is supplied to the second scan line S2*n* so that the second transistors M2-1 and M2-2 are turned on. When the second transistors M2-1 and M2-2 are turned on, the third node N3, the second node N2, and the first node N1 are electrically coupled to each other. At this time, the first node N1 and the third node N3 receive the first power ELVDD from the first power source so that the first transistor M1 is set in a turned off state. That is, during the period in which the first second scan signal 1SS2 is supplied, the off bias voltage is supplied to the first transistor M1 so that the characteristic of the first transistor M1 is initialized.

Then, the emission control signal is supplied to the emission control line En and the second second scan signal 2SS2 is supplied to the second scan line S2*n*. When the emission control signal is supplied to the emission control line En, the fifth transistor M5 and the sixth transistor M6 are turned off. When the second second scan signal 2SS2 is supplied to the second scan line S2*n*, the second transistors M2-1 and M2-2 are turned on.

When the second transistors M2-1 and M2-2 are turned on, the initialization voltage Vint of the initialization power source supplied to the power source line VLn is supplied to the first node N1 so that the first node N1 is initialized to the initialization voltage Vint of the initialization power source. During the period where the second transistors M2-1 and M2-2 are turned on, the initialization power Vint of the initialization power source is also supplied to the third node N3 so that the first transistor M1 is set in an off state and so that the characteristic of the first transistor M1 may be initialized more uniformly.

Then, the first scan signal is supplied to the first scan line S1*n* so that the third transistor M3 and the fourth transistor M4 are turned on. When the fourth transistor M4 is turned on, the first transistor M1 is diode coupled. When the third transistor M3 is turned on, the data signal from the data line Dm is supplied to the third node N3.

At this time, because the first node N1 is set to have the initialization voltage Vint of the initialization power source which is lower than the data signal, the first transistor M1 is turned on. When the first transistor M1 is turned on, the voltage obtained by subtracting the threshold voltage of the first transistor M1 from the data signal is supplied to the first node N1. The storage capacitor Cst charges (e.g., stores) a voltage (e.g., a predetermined voltage) corresponding to the voltage applied to the first node N1.

After the voltage (e.g., the predetermined voltage) is stored in the storage capacitor Cst, the supply of the emission control signal to the emission control line En is stopped so that the fifth transistor M5 and the sixth transistor M6 are turned on. When the fifth transistor M5 and the sixth transistor M6 are turned on, a current path from the first power source supplying the first supply voltage ELVDD to the second power source supplying the second supply voltage ELVSS via the OLED is formed. The first transistor M1 controls the amount of current (e.g., the magnitude of the current) supplied to the OLED in accordance with the voltage charged in the storage capacitor Cst.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode (OLED) having a cathode electrode coupled to a second power source;

a first transistor having a first electrode coupled to a first power source, the first transistor being configured to control a magnitude of a current supplied from the first power source to the second power source via a second electrode of the first transistor and the OLED in accordance with a data signal; and a plurality of second transistors serially coupled between a gate electrode of the first transistor and a power source line, the second transistors being configured to be turned on when a second scan signal is supplied to a second scan line, wherein a common node between the second transistors is electrically coupled to the first electrode or the second electrode of the first transistor.

2. The pixel as claimed in claim 1, wherein the power source line supplies an initialization voltage, the initialization voltage having a voltage lower than a voltage of the data signal.

3. The pixel as claimed in claim 1, further comprising:

a third transistor coupled between the first electrode of the first transistor and a data line, the third transistor being configured to be turned on when a first scan signal is supplied to a first scan line;

a fourth transistor coupled between the gate electrode of the first transistor and the second electrode of the first transistor, the fourth transistor being configured to be turned on when the first scan signal is supplied to the first scan line;

a fifth transistor coupled between the first electrode of the first transistor and the first power source, the fifth transistor being configured to be turned off when an emission control signal is supplied to an emission control line;

a sixth transistor coupled between the second electrode of the first transistor and the OLED, the sixth transistor being configured to be turned off when the emission control signal is supplied; and a storage capacitor coupled between the gate electrode of the first transistor and the first power source.

4. An organic light emitting display, comprising:

a scan driver configured to drive a plurality of first scan lines, a plurality of second scan lines, and a plurality of emission control lines;

a data driver configured to supply a plurality of data signals to a plurality of data lines; and a plurality of pixels at crossing regions of the first scan lines and the data lines, the pixels being arranged in a plurality of horizontal lines, wherein each of the pixels in an ith horizontal line of the horizontal lines comprises:

an OLED having a cathode electrode coupled to a second power source;

a first transistor having a first electrode coupled to a first power source, the first transistor being configured to control a magnitude of a current supplied from the first power source to the second power source via a second electrode of the first transistor and the OLED in accordance with the data signal; and a plurality of second transistors serially coupled between a gate electrode of the first transistor and an ith power source line of a plurality of power source lines, the gate electrodes of the second transistors being coupled to an ith second scan line of the second scan lines, wherein a common node between the second transistors is electrically coupled to the first electrode or the second electrode of the first transistor.

5. The organic light emitting display as claimed in claim 4, wherein the ith power source line is configured to supply an initialization voltage, the initialization voltage having a voltage less than a voltage of the data signal.

6. The organic light emitting display as claimed in claim 4, wherein each of the pixels in the ith horizontal line further comprises:

a third transistor coupled between the first electrode of the first transistor and a data line, the third transistor having a gate electrode coupled to an ith first scan line;

a fourth transistor coupled between the gate electrode of the first transistor and the second electrode of the first transistor, the fourth transistor having a gate electrode coupled to the ith first scan line;

a fifth transistor coupled between the first electrode of the first transistor and the first power source, the fifth transistor having a gate electrode coupled to an ith emission control line of the emission control lines;

a sixth transistor coupled between the second electrode of the first transistor and the OLED, the sixth transistor having a gate electrode coupled to the ith emission control line; and a storage capacitor coupled between the gate electrode of the first transistor and the first power source.

7. The organic light emitting display as claimed in claim 4, wherein an ith (i is a natural number) second scan line of the second scan lines is electrically coupled to an (i−1)th first scan line of the first scan lines.

8. The organic light emitting display as claimed in claim 4, wherein the scan driver is configured to sequentially supply a plurality of first scan signals to the first scan lines and a plurality of second scan signals to the second scan lines to turn on corresponding ones of the transistors and to sequentially supply a plurality of emission control signals to the emission control lines to turn off corresponding ones of the transistors.

9. The organic light emitting display as claimed in claim 8, wherein the scan driver is further configured to supply a second scan signal to an ith (i is a natural number) second scan line, wherein the second scan signal does not overlap a first scan signal supplied to an ith first scan line, wherein the second scan signal has a larger width than the first scan signal and is supplied to the ith second scan line before the first scan signal is supplied to the ith first scan line.

10. The organic light emitting display as claimed in claim 9, wherein the scan driver is configured to supply an emission control signal to an ith (i is a natural number) emission control line, wherein the emission control signal overlaps with the first scan signal and the second scan signal supplied to the ith first scan line and the ith second scan line, respectively.

11. The organic light emitting display as claimed in claim 4, wherein one of the power source lines is formed in each horizontal line of the display and each of the power source lines is coupled to an initialization power source driver configured to drive the power source lines of the horizontal lines.

12. The organic light emitting display as claimed in claim 11, wherein the scan driver is configured to sequentially supply a first scan signal to each of the first scan lines, to sequentially supply two second scan signals to each of the second scan lines, and to sequentially supply an emission control signal to each of the emission control lines.

13. The organic light emitting display as claimed in claim 12, wherein the scan driver is configured to supply a first scan signal to an ith (i is a natural number) first scan line after supplying the second scan signals to the ith second scan line, wherein the two second scan signals comprise a first second scan signal and a second second scan signal.

14. The organic light emitting display as claimed in claim 13, wherein the scan driver is configured to supply an emission control signal to an ith emission control line and wherein the emission control signal overlaps the first scan signal supplied to the ith first scan line and the second second scan signal supplied to the ith second scan line.

15. The organic light emitting display as claimed in claim 13, wherein the initialization power source driver is configured to supply an initialization voltage having a voltage lower than a voltage of the data signal, the initialization voltage being supplied to the ith power source line to overlap the second second scan signal supplied to the ith second scan line.

16. The organic light emitting display as claimed in claim 15, wherein the ith power source line is set in a floating state in periods other than a period in which the initialization power source is supplied.

17. The organic light emitting display as claimed in claim 13, wherein the scan driver is configured to supply the second second scan signal to the ith second scan line no less than one horizontal period 1H after the end of the first second scan signal.

* * * * *